US007449653B2

(12) United States Patent
Gibson et al.

(10) Patent No.: US 7,449,653 B2
(45) Date of Patent: Nov. 11, 2008

(54) POSITIVE RESETTING CLOSE LATCH FOR CLOSING ELECTRICAL SWITCHING APPARATUS

(75) Inventors: Perry R. Gibson, East Palestine, OH (US); Paul R. Rakus, Beaver Falls, PA (US); Douglas C. Marks, Murrysville, PA (US); Andrew L. Gottschalk, Pittsburgh, PA (US); Robert M. Slepian, Murrysville, PA (US); Roger J. Briggs, Colgate, WI (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 11/759,629

(22) Filed: Jun. 7, 2007

(65) Prior Publication Data

US 2008/0237016 A1 Oct. 2, 2008

Related U.S. Application Data

(63) Continuation-in-part of application No. 11/693,198, filed on Mar. 29, 2007.

(51) Int. Cl.
*H01H 5/00* (2006.01)

(52) U.S. Cl. ..... 200/400; 200/318

(58) Field of Classification Search ..... 200/400, 200/401, 500, 501, 318, 321–327; 335/172
See application file for complete search history.

(56) References Cited

U.S. PATENT DOCUMENTS

| | | | | |
|---|---|---|---|---|
| 4,219,713 | A * | 8/1980 | Maier et al. | 200/400 |
| 5,224,590 | A * | 7/1993 | Milianowicz et al. | 200/400 |
| 6,362,442 | B1 * | 3/2002 | Engel et al. | 200/400 |
| 6,437,269 | B1 * | 8/2002 | Rakus | 200/400 |
| 6,472,627 | B1 * | 10/2002 | Yoon | 200/400 |
| 6,515,245 | B2 * | 2/2003 | Marin-Pache et al. | 200/400 |
| 6,870,113 | B2 * | 3/2005 | Dahl et al. | 200/318 |
| 7,038,155 | B2 * | 5/2006 | Ahlert et al. | 200/400 |
| 7,294,804 | B1 * | 11/2007 | Gottschalk et al. | 200/400 |
| 7,368,677 | B2 * | 5/2008 | Jones et al. | 200/400 |

* cited by examiner

*Primary Examiner*—Michael A Friedhofer
(74) *Attorney, Agent, or Firm*—Martin J. Moran

(57) ABSTRACT

A latch assembly for an electrical switching apparatus operating mechanism is provided. The latch assembly is structured so that force from the closing spring is directed along a line extending through the pivot point of a latch prop. A reset assembly for the latch prop is also provided.

17 Claims, 8 Drawing Sheets

POSITIVE RESETTING CLOSE LATCH FOR CLOSING ELECTRICAL SWITCHING APPARATUS

CROSS REFERENCE TO RELATED APPLICATION

This application is continuation-in-part of application Ser. No. 11/693,198, filed Mar. 29, 2007, entitled "SPRING DRIVEN RAM FOR CLOSING AN ELECTRICAL SWITCHING APPARATUS".

BACKGROUND OF THE INVENTION

1. Field of the Invention

The present invention relates to an electrical switching apparatus operating mechanism and, more specifically to a closing latch assembly and a latch reset assembly within the operating mechanism.

2. Background Information

An electrical switching apparatus, typically, includes a housing, at least one bus assembly having a pair of contacts, a trip device, and an operating mechanism. The housing assembly is structured to insulate and enclose the other components. The at least one pair of contacts include a fixed contact and a movable contact and typically include multiple pairs of fixed and movable contacts. Each contact is coupled to, and in electrical communication with, a conductive bus that is further coupled to, and in electrical communication with, a line or a load. A trip device is structured to detect an over current condition and to actuate the operating mechanism. An operating mechanism is structured to both open the contacts, either manually or following actuation by the trip device, and close the contacts.

That is, the operating mechanism includes both a closing assembly and an opening assembly, which may have common elements, that are structured to move the movable contact between a first, open position, wherein the contacts are separated, and a second, closed position, wherein the contacts are coupled and in electrical communication. The operating mechanism, may, includes a rotatable pole shaft that is coupled to the movable contact and structured to move each movable contact between the closed position and the open position. Elements of both the closing assembly and the opening assembly are coupled to the pole shaft so as to effect the closing and opening of the contacts.

Low and medium voltage selective electrical switching apparatus typically had a stored energy device, such as an opening spring, and at least one link coupled to the pole shaft. The at least one link, typically, included two links that acted cooperatively as a toggle assembly. When the contacts were open, the toggle assembly was in a first, collapsed configuration and, conversely, when the contacts were closed, the toggle assembly was, typically, in a second, near toggle position, toggle position, or in a slightly over-toggle position. The spring biased the toggle assembly to the collapsed position. The spring and toggle assembly were maintained in the second, toggle position by the trip device.

The trip device included an over-current sensor, a latch assembly and may have included one or more additional links that were coupled to the toggle assembly. Alternately, the latch assembly was directly coupled to the toggle assembly. When an over-current situation occurred, the latch assembly was released allowing the opening spring to cause the toggle assembly to collapse. When the toggle assembly collapsed, the toggle assembly link coupled to the pole shaft caused the pole shaft to rotate and thereby move the movable contacts into the open position.

In a low and medium voltage electrical switching apparatus, the force required to close the contacts was, and is, may be greater than what a human may apply and, as such, the operating mechanism typically included a mechanical closing assembly to close the contacts. The closing assembly, typically, included at least one stored energy device, such as a spring, and/or a motor. Closing springs typically were about 2 inches in diameter and about 5 to 6 inches in length. These springs were structured to apply a force of about 1,000 pounds. A common configuration included a motor that compressed one or more springs in the closing assembly. That is, the closing springs were coupled to a cam roller that engaged a cam coupled to the motor. As the motor rotated the cam, the closing springs were compressed or charged. The toggle assembly also included a cam roller, typically at the toggle joint. The closing assembly further included one or more cams disposed on a common cam shaft with the closing spring cam. Alternatively, depending upon the configuration of the cam, both the closing spring cam roller and the toggle assembly cam roller could engage the same cam. When the closing springs were released, the closing spring cam roller applied force to the associated cam and caused the cam shaft to rotate. That is, the cam roller "operatively engaged" the cam. Rotation of the cam shaft would also cause the cam associated with the toggle assembly cam roller to rotate. As the cam associated with the toggle assembly cam roller rotated, the cam caused the toggle assembly cam roller, and therefore the toggle assembly, to be moved into selected positions and/or configurations. More specifically, the toggle assembly was moved so as to rotate the pole shaft into a position wherein the contacts were closed. Thus, the stored energy from the closing springs was transferred via the cams, cam shaft, toggle assembly, and pole shaft to the contacts.

For example, during a closing procedure the toggle assembly would initially be collapsed and, therefore, the contacts were open. When the closing springs were released, the rotation of the cam associated with the toggle assembly cam roller would cause the toggle assembly to move back into the second, toggle position, thereby closing the contacts. This motion would also charge the opening springs. Simultaneously, or near simultaneously, the trip device latch would be reset thereby holding the toggle assembly in the second, toggle position. After the contacts were closed, it was common to recharge the closing spring so that, following an over current trip, the contacts could be rapidly closed again. That is, if the closing springs were charged, the contacts could be closed almost immediately without having to wait to charge the closing springs.

While this configuration is effective, there are a substantial number of components required, each of which requires space to operate within and each of which are subject to wear and tear. Further, certain components are exposed to considerable force, which enhances wear and tear, during operations wherein that particular component is not in use. Accordingly, one improvement to this configuration is to include a ram assembly structured to act directly on the toggle assembly, as disclosed in the related application set forth above. That is, rather than utilizing a closing spring coupled to a roller to operatively engage a cam and having the toggle assembly with a roller coupled to another cam, the spring driven ram for closing an electrical switching apparatus utilizes a spring driven ram that engages the toggle assembly.

The ram assembly includes a ram body that travels on at least one, and preferably two, guide pins between a first, retracted position and a second, extended position. When the ram body is in the first, retracted position, the ram assembly springs are compressed. The toggle joint, when collapsed, is disposed in the ram body path of travel. Thus, when the ram assembly is released, the ram body moves over a path of travel to the second, extended position. While moving, the ram body engages the toggle joint and moves the toggle assembly into its over-toggle configuration.

The ram body path of travel is defined by a guide assembly having, preferably, two guide pins. The guide pins are maintained in a spaced, generally parallel relationship by a base plate at one end and a stop plate at the other end. The ram assembly springs are disposed between the base plate and the ram body and are structured to bias the ram body toward the stop plate. When the springs are charged and the ram assembly is released, the ram body moves over the guide pins and impacts the stop plate.

While the ram assembly requires few components, reduces the wear and tear on those components and may fit into a reduced space, the ram assembly further allows for the use of a closing latch assembly unlike those found in the prior art.

SUMMARY OF THE INVENTION

The closing latch assembly set forth below includes a latch assembly with a latch prop structured to be engaged by a latch lobe disposed on the cam shaft further coupled to the closing cam. The latch prop is pivotally coupled to the electrical switching apparatus housing assembly and structured to move between a first position and a second position. When the latch prop is in the first position, the ram assembly spring biases the latch prop toward the second position; however, the latch prop is also engaged by a latch D-shaft that prevents the latch prop from moving into the second position. When the closing assembly is actuated by a user, the latch D-shaft rotates and allows the latch prop to move into the second position.

The bias from the ram assembly spring is applied to the latch prop via the latch lobe. The latch lobe includes a radial extension that allows the force to be applied in a direction passing through the pivot point of the latch prop when the latch prop is in the first position. Because the line of force passes generally through the latch prop pivot point, the torque and other such loads are reduced within the latch prop.

Further, the latch assembly includes a reset assembly. Preferably, the reset assembly includes a reset pin that extends perpendicular to the latch prop body and into the path of travel of the latch lobe radial extension. Thus, as the latch lobe rotates with the cam shaft during the recharging of the ram assembly springs, the latch lobe radial extension engages the reset pin and causes the latch prop to be returned to the first position.

BRIEF DESCRIPTION OF THE DRAWINGS

A full understanding of the invention can be gained from the following description of the preferred embodiments when read in conjunction with the accompanying drawings in which:

FIG. 2B is a side view of an electrical switching apparatus with a front cover removed and selected components removed for clarity and with the latch assembly in a second position.

DESCRIPTION OF THE PREFERRED EMBODIMENTS

As used herein, "coupled" means a link between two or more elements, whether direct or indirect, so long as a link occurs.

As used herein, "directly coupled" means that two elements are directly in contact with each other.

As used herein, "fixedly coupled" or "fixed" means that two components so coupled move as one.

As used herein, "operatively engage" when used in relation to a component that is directly coupled to a cam means that a force is being applied by that component to the cam sufficient to cause the cam to rotate.

As used herein, "coplanar" means in the same plane, or a generally parallel plane. That is, if one component has a generally flat body and a second component is coplanar, or disposed in a coplanar manner, the second component is disposed within the plane of the first component flat body, or, in a plane generally parallel to the plane of the first component flat body.

Figure 1:
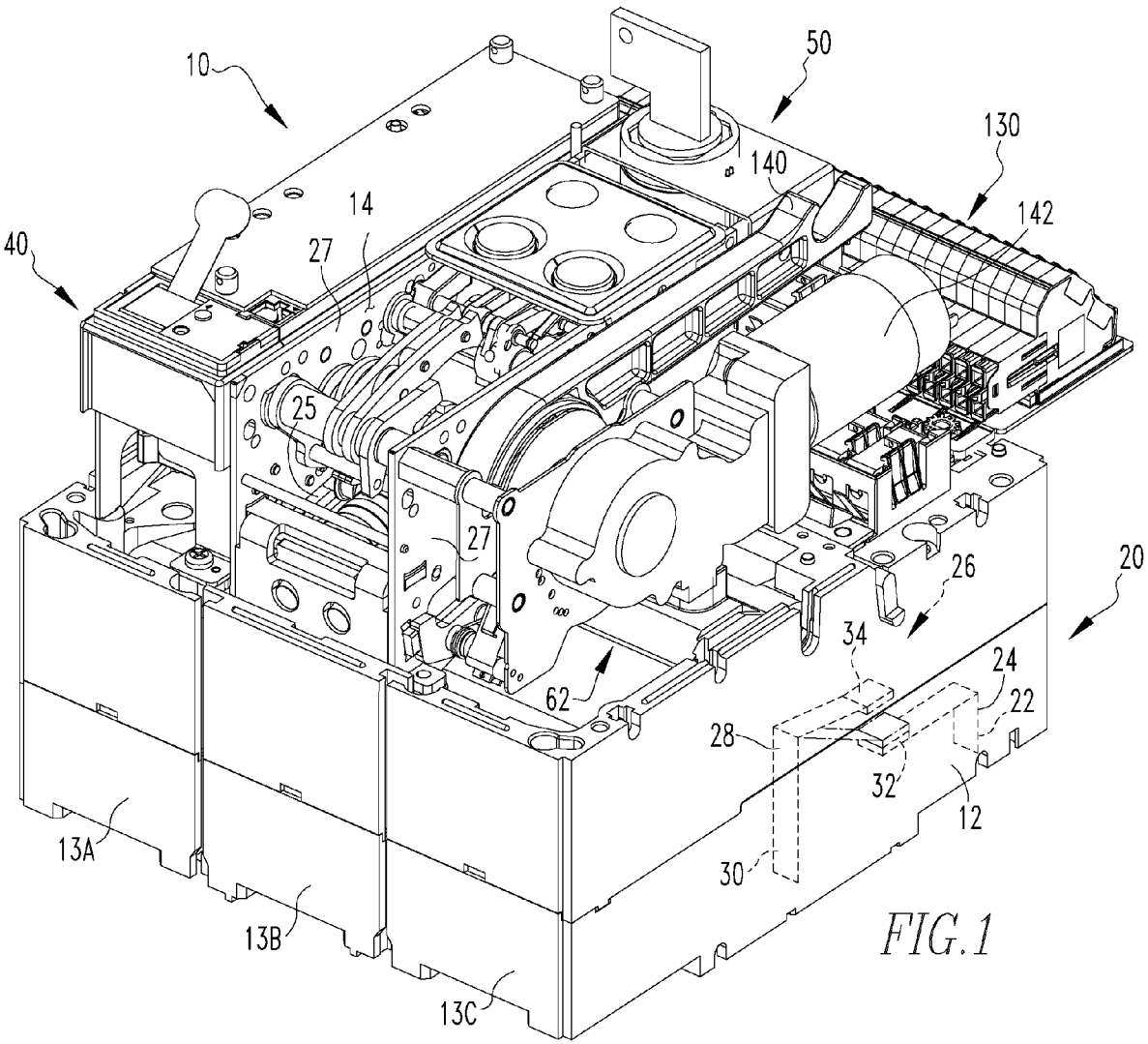
FIG. 1 is an isometric view of an electrical switching apparatus with a front cover removed.

As shown in FIG. 1, an electrical switching apparatus 10 includes a housing assembly 12 defining an enclosed space 14. In FIG. 1, the front cover of the housing assembly 12 is not shown, but it is well known in the art. The electrical switching apparatus 10 further includes a conductor assembly 20 (shown schematically) having at least one line terminal 22, at least one line conductor 24, at least one pair of separable contacts 26, at least one load conductor 28 and at least one load terminal 30. The at least one pair of separable contacts 26 include a fixed contact 32 and a movable contact 34. The movable contact 34 is structured to move between a first, open position, wherein the contacts 32, 34 are separated, and a second, closed position, wherein the contacts 32, 34 contact each other and are in electrical communication. The electrical switching apparatus 10 further includes a trip device 40 and an operating mechanism 50. The operating mechanism 50, which is discussed in more detail below, is generally structured to move the at least one pair of separable contacts 26 between the first, open position and the second, closed position. The trip device 40 is structured to detect an over current condition and, upon detecting such a condition, to actuate the operating mechanism 50 to open the at least one pair of separable contacts 26.

The electrical switching apparatus 10 also includes at least two, and typically a plurality, of side plates 27. The side plates 27 are disposed within the housing assembly 12 in a generally parallel orientation. The side plates 27 include a plurality of openings 29 to which other components may be attached or through which other components may extend. As discussed below, the openings 29 on two adjacent side plates 27 are typically aligned. While side plates 27 are the preferred embodiment, it is understood that the housing assembly 12 may also be adapted to include the required openings and/or attachment points thereby, effectively, incorporating the side plates 27 into the housing assembly 12 (not shown).

An electrical switching apparatus 10 may have one or more poles, that is, one or more pairs of separable contacts 26 each having associated conductors and terminals. As shown in the Figures the housing assembly 12 includes three chambers 13A, 13B, 13C each enclosing a pair of separable contacts 26 with each being a pole for the electrical switching apparatus 10. A three pole configuration, or a four pole configuration having a neutral pole, is well known in the art. The operating mechanism 50 is structured to control all the pairs of separable contacts 26 within the electrical switching apparatus 10. Thus, it is understood selected elements of the operating mechanism 50, such as, but not limited to, the pole shaft 56 (discussed below) span all three chambers 13A, 13B, 13C and engage each pair of separable contacts 26. The following discussion, however, shall not specifically address each specific pair of separable contacts 26.

As shown in FIG. 2, the operating mechanism 50 includes an opening assembly 52, structured to move the at least one pair of separable contacts 26 from the second, closed position to the first, open position, and a closing assembly 54, structured to move the at least one pair of separable contacts 26 from the first, open position to the second closed position. The opening assembly 52 and the closing assembly 54 both utilize common components of the operating mechanism 50. The opening assembly 52 is not part of the claimed invention, however, for the purpose of the following discussion, it is understood that the opening assembly 52 is the assembly structured to move various components to the positions discussed below. Further, it is noted that the opening assembly 52 includes a cradle assembly 53 that, among other functions, acts as a toggle stop and as a toggle kicker for the toggle assembly 58 (discussed below).

Figure 2A:
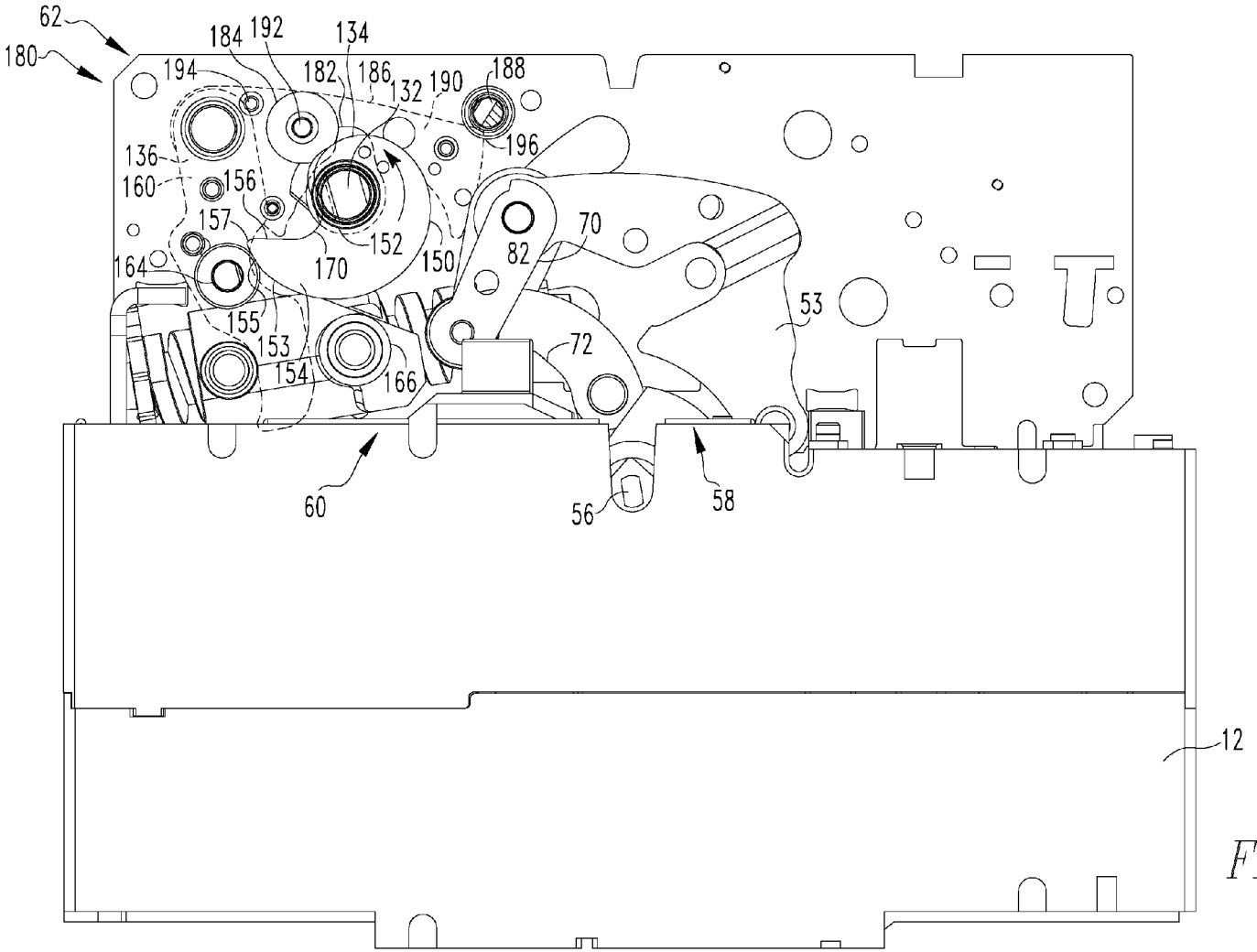
FIG. 2A is a side view of an electrical switching apparatus with a front cover removed and selected components removed for clarity and with the latch assembly in a first position.
Figure 3B:
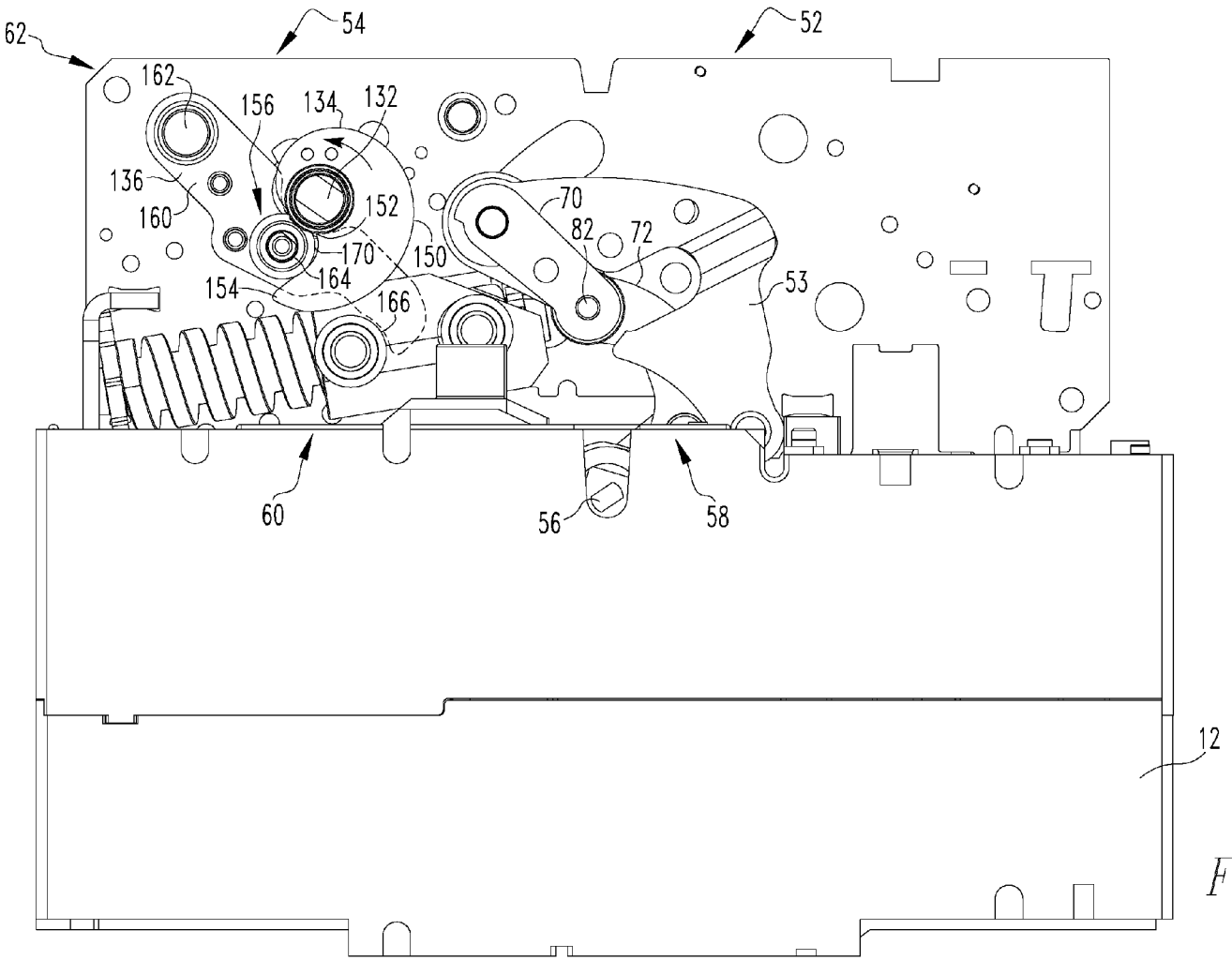
FIG. 3 is an isometric view of the closing assembly with a side plate removed for clarity.
Figure 3:
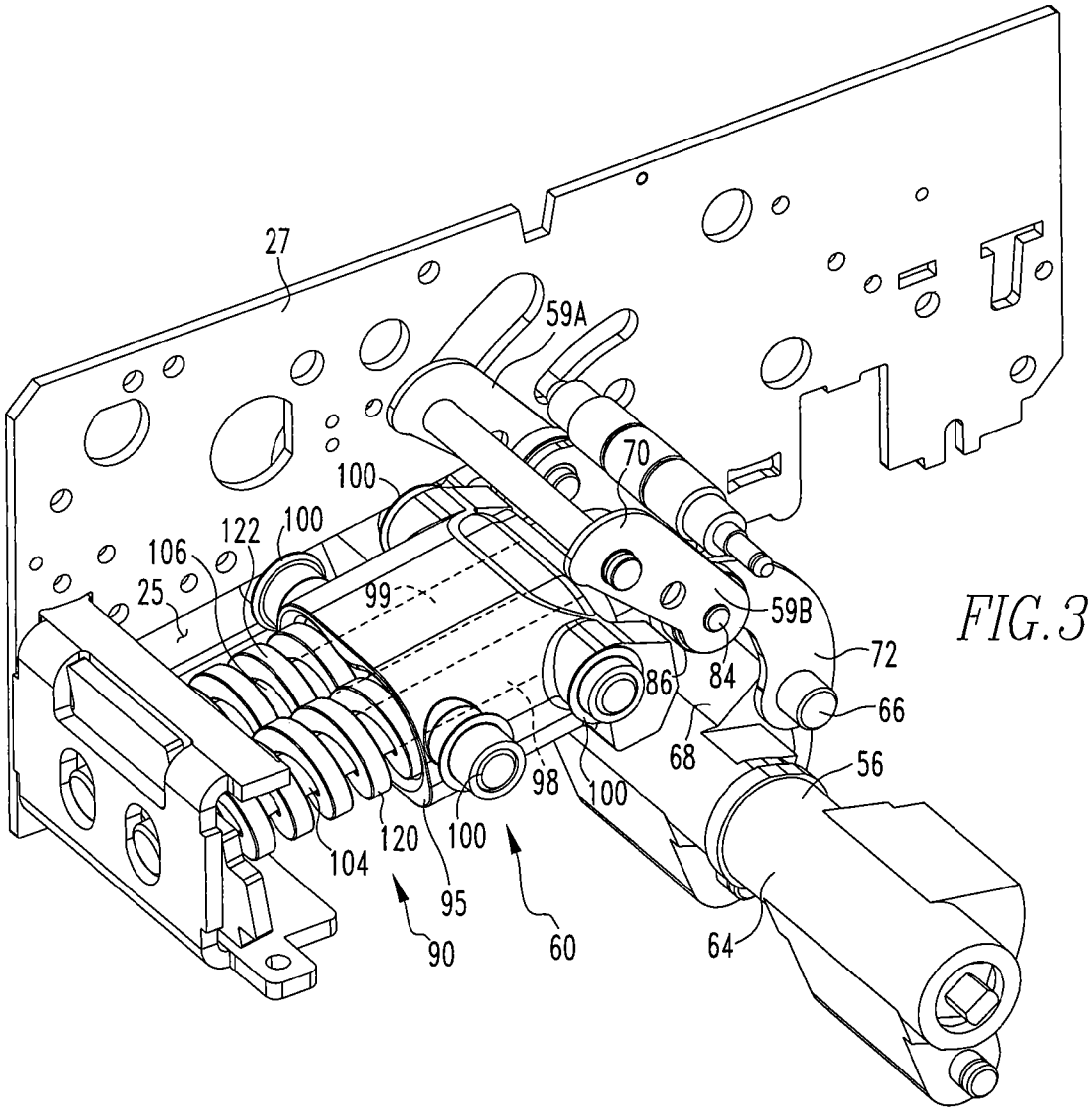
Figure 4:
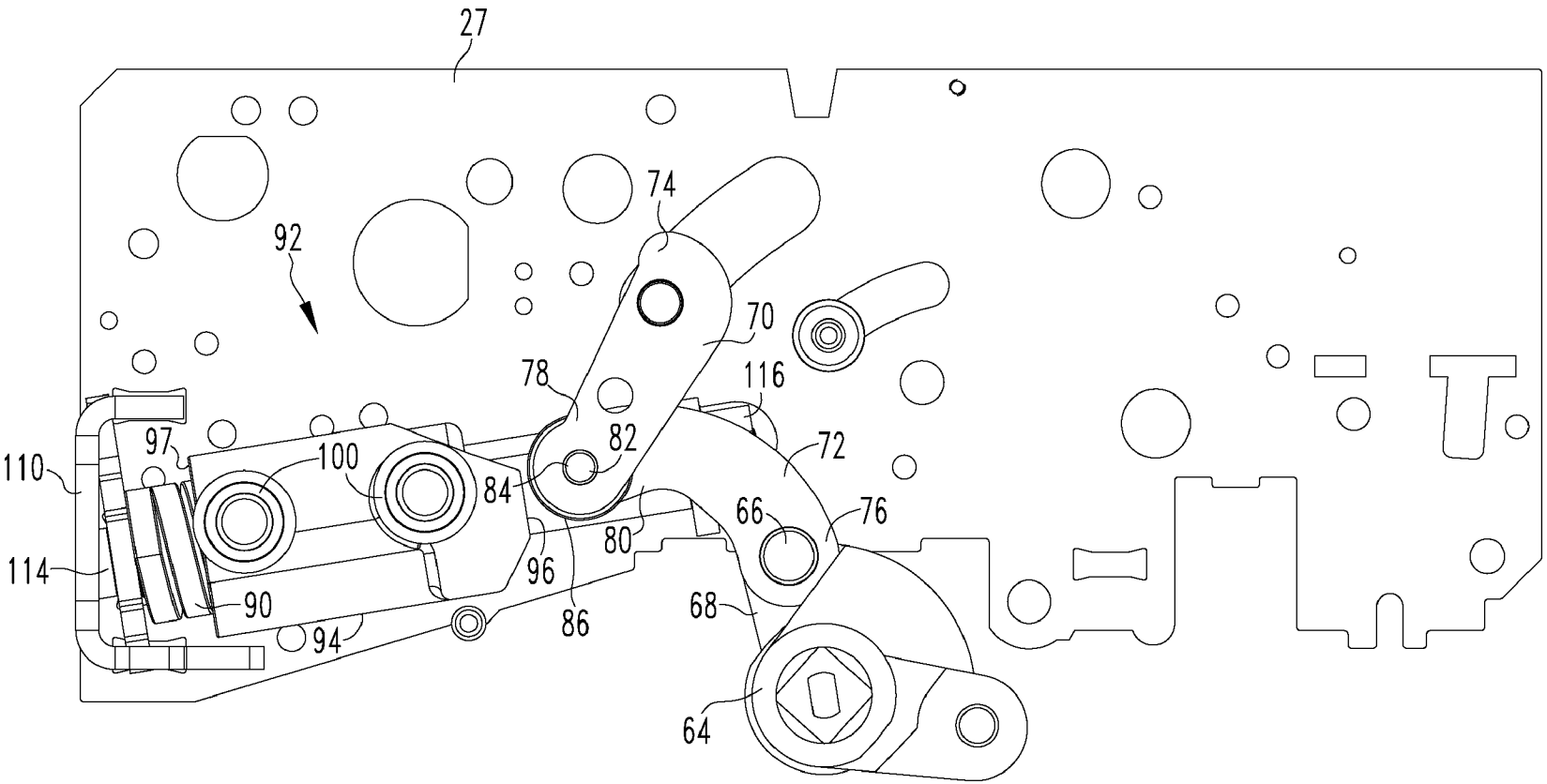
FIG. 4 is a side view of the ram assembly and the toggle assembly in a first position/configuration.

As shown in FIGS. 2-4, the closing assembly 54 includes a pole shaft 56, a toggle assembly 58, a ram assembly 60, and a charging assembly 62 (FIG. 1). The pole shaft 56 is an elongated shaft body 64 rotatably coupled to the housing assembly 12 and/or side plates 27. The pole shaft 56 includes a plurality of mounting points 66 disposed on mounting blocks 68 extending from the pole shaft body 64. The pole shaft 56 is coupled to the movable contact 34. The pole shaft 56 is structured to move between a first position, wherein the movable contact 34 is in its first, open position, and a second position, wherein the movable contact 34 is in its second, closed position.

It is noted that, as shown in FIG. 3, a single "link" in the toggle assembly 58 may include two, or more, members 59A, 59B with similar shapes which are held in a spaced relationship and which move in concert. The use of multiple link members 59A, 59B may be used, for example, to provide added strength to the link or where space considerations do not allow for a single thick link. Because these link members 59A, 59B perform the same function, have a similar shape, and move in concert, the following discussion will simply identify the link by a single reference number as is shown in the side views of FIGS. 4 and 5. It is understood that the description of a link applies to both link members 59A, 59B. Other components in the closing assembly 54 may also be constructed using various laminations or layers which sandwich each other. It is further understood that these components, such as, but not limited to, the toggle assembly members 59A, 59B and the rocker arm assembly body 160 (discussed below) each move in their own plane. The plane of travel for such components is generally parallel to the plane of the side plates 27.

Figure 5:
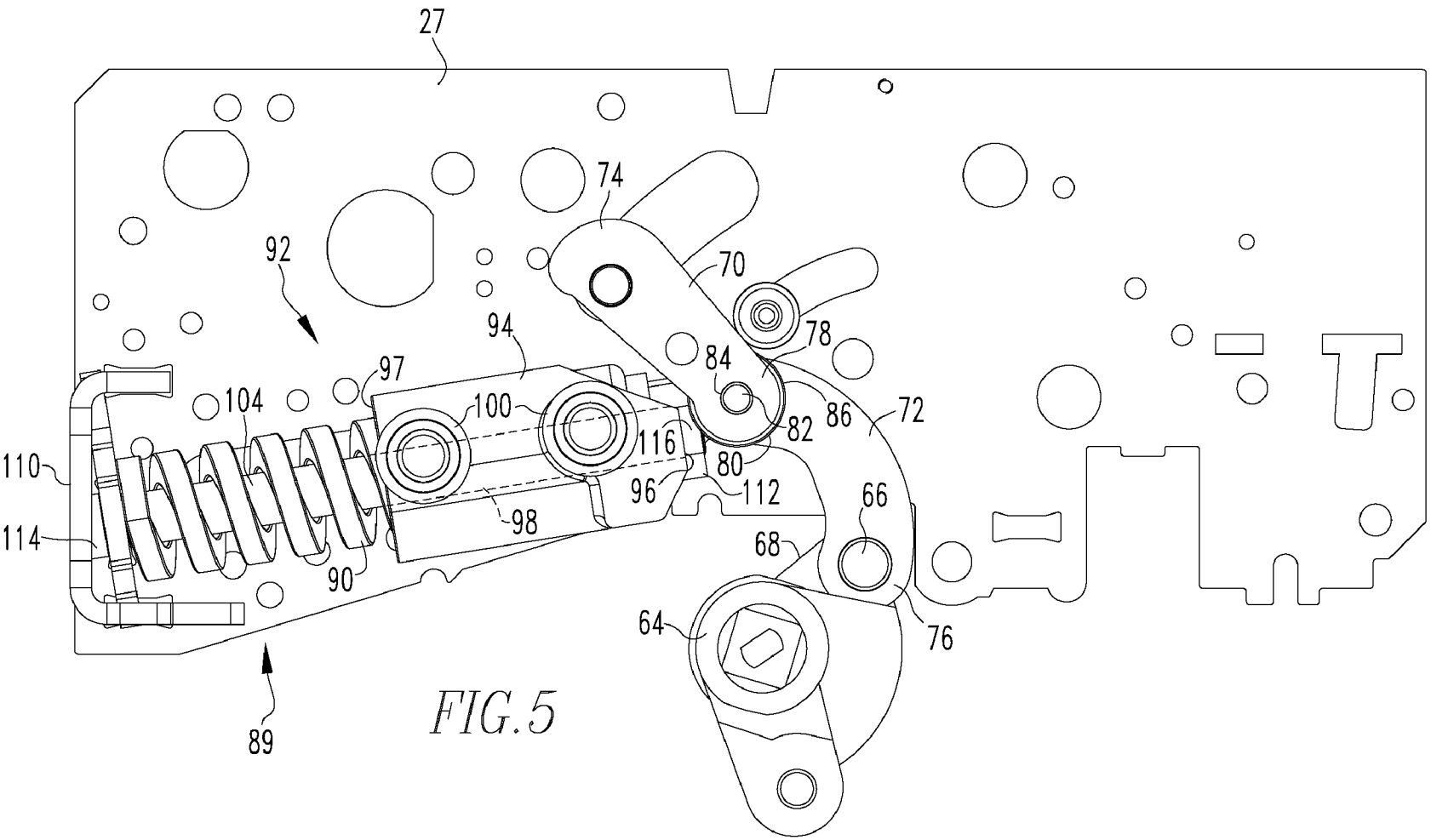
FIG. 5 is a side view of the ram assembly and the toggle assembly in a second position/configuration.

As shown in FIGS. 4 and 5, the toggle assembly 58 includes a first link 70 and a second link 72 which are each generally flat, elongated bodies. The first and second links 70, 72 each have a first, outer end 74, 76 (respectively) and a second, inner end 78, 80 (respectively). The first link 70 and the second link 72 are rotatably coupled together at the first link inner end 78 and the second link inner end 80. In this configuration, the first and second links 70, 72 form a toggle joint 82. The toggle joint 82 may include a toggle roller 86. That is, the first link inner end 78 and the second link inner end 80 may be rotatably coupled together by a pin 84 extending generally perpendicular to the plane of each link 70, 72. The pin 84 may also define an axle for the toggle roller 86 which is, essentially, a wheel. The toggle roller 86 has a diameter of sufficient size to extend past the edges of the first and second links 70, 72. The first link outer end 74 is rotatably coupled to the housing assembly 12 and/or side plates 27. For the purpose of this disclosure, the first link outer end 74 may be considered to be fixed pivot point, however, it is noted that the first link outer end 74 is movably mounted in a slot 25 on the side plate 27. The second link outer end 76 is rotatably coupled to the pole shaft 56 and, more specifically, rotatably coupled to a mounting point 66.

The toggle assembly 58 is structured to move between a first, collapsed configuration (FIG. 4) and a second, slightly over-toggle configuration (FIG. 5). In the over-toggle configuration, the toggle assembly is typically between about 5 degrees and 15 degrees past toggle and, preferably about 10 degrees past toggle. In the first, collapsed configuration, the first and second link outer ends 74, 76 are generally closer together than when the toggle assembly 58 is in the second, over-toggle configuration. Thus, because the first link outer end 74 is a fixed pivot point, as the toggle assembly 58 moves between the first, collapsed configuration and the second, over-toggle configuration, the second link outer end 76 is drawn toward, or pushed away from, the first link outer end 74. This motion causes the pole shaft 56 to move between its first and second positions. That is, when the toggle assembly 58 is in the first, collapsed configuration, the pole shaft 56 is in its first position, and, as noted above, the movable contact 34 is in its first, open position. Further, when the toggle assembly 58 is in the second, over-toggle configuration, the pole shaft 56 is in its second position, and, as noted above, the movable contact 34 is in its second, closed position.

The ram assembly 60 has at least one biasing device 89, preferably a compression spring 90, a guide assembly 92, and a ram body 94. The ram body 94, preferably, includes a generally flat forward surface 96 that is structured to engage the toggle joint 82, and more preferably the toggle roller 86. The ram body 94 may be solid but, in a preferred embodiment, the ram body 94 is substantially hollow having a loop-like side wall 95 (FIG. 3) coupled to cap-like a front plate 93 (FIG. 2A). The forward surface 96 is the outer surface of the front plate 93. The ram body 94 is structured to move between a first, retracted position and a second, extended position along a path of travel defined by the guide assembly 92. In one embodiment the ram body 94 has a lateral width of about 2.1 inches and defines at least one, and preferably two passages 98, 99 (FIG. 3) extending in the direction of the path of travel. The ram body 94 may also have at least one, and preferably two rollers 100 disposed on opposite lateral sides of the ram body 94. The passages 98, 99 and the ram rollers 100 cooperate with an associated embodiment of the guide assembly 92. That is, for this embodiment, the guide assembly 92 includes at least one, and preferably two elongated, generally straight pins 104, 106 (FIG. 3) that are disposed in a spaced, generally parallel orientation. Further, the housing assembly 12 and/or side plates 27 may define slots 25 disposed on either side of the ram body 94 path of travel. When assembled, the pins 104, 106 extend through the passages 98, 99 and the ram body rollers 100 are each disposed in one of the slots 25. In this configuration, the ram body 94 is limited to a generally linear motion defined by the guide assembly 92.

The guide assembly 92 further includes a base plate 110 and a stop plate 112. Each pin 104, 106 has a base end 114 and a tip end 116. Each pin base end 114 is coupled to the base plate 110 and each pin tip end 116 is coupled to the stop plate 112 (FIG. 5). That is, the base plate 110 and the stop plate 112 maintain the pins 104, 106 in a spaced, generally parallel configuration. Further, in the embodiment described above, the base plate 110 and the stop plate 112 further limit and define the ram body 94 path of travel. That is, the ram body 94 is trapped between the base plate 110 and the stop plate 112.

The at least one spring 90 is structured to bias the ram body 94 from the first, retracted position toward the second, extended position. When the ram body 94 is in the first, retracted position, the at least one spring 90 is charged or compressed. When the ram body 94 is in the second, extended position, the at least one spring 90 is discharged. Preferably, the at least one spring 90 is disposed between the base plate 110 and a ram body back surface 97 (FIG. 2B). The ram body back surface 97 is, preferably, the interior side of the front plate 93. That is, the ram body back surface 97 is disposed on the opposite side of the front plate 93 from the forward surface 96. In the embodiment disclosed above, i.e., a ram body 94 with two passages 98, 99 and two pins 104, 106, the at least one spring 90 is preferably two springs 120, 122 and each spring 120, 122 is disposed about one of the two pins 104, 106. For a 600 volt electrical switching apparatus, wherein the closing energy required to close three pairs of contacts 26 is as much as 50 joules, the springs 120, 122 may each be about 3.5 inches long and about 0.75 inches in diameter.

As shown in FIGS. 1 and 2, the charging assembly 62 includes a charging operator 130, a cam shaft 132, a cam 134, and a rocker arm assembly 136. The charging operator 130 is a device coupled to, and structured to rotate, the cam shaft 132. The charging operator 130 may be a manually powered handle assembly 140 and/or a powered motor 142 as shown in FIG. 1. The cam shaft 132 is an elongated shaft that is rotatably coupled to the housing assembly 12 and/or side plates 27. The cam 134 is fixed to the cam shaft 132 and structured to rotate therewith about a pivot point. The cam 134 includes an outer cam surface 150. The outer cam surface 150 has a point of minimal radius 152, a point of greatest radius 154, and a stop radius 155. The cam 134 is structured to rotate in a single direction as indicated by the arrow in FIG. 2. The outer cam surface 150 increases gradually in radius from the point of minimal radius 152 to the point of greatest radius 154 in the direction of rotation. After the cam point of greatest radius 154, the radius of the outer cam surface 150 is reduced slightly over a downslope 153. The downslope 153 leads to a stop radius 155 and then a tip 157. As set forth below, the downslope 153 to the stop radius 155 is a surface to which the force from the at least one spring 90 is applied and which encourages rotation in the proper direction so that when the "close latch" releases the cam shaft 132 rotates from the stop radius 155 to the cam tip 157 where the cam follower 164 falls off the cam tip 157 and into the pocket of the cam 152. As is shown, the outer cam surface point of minimal radius 152 and the outer cam tip 157 are disposed immediately adjacent to each other on the outer cam surface 150. Thus, there is a step 156 between the point of minimal radius 152 and the cam tip 157. It is further noted that, due to the radius of the cam follower 164 (discussed below) the cam follower 164 does not engage the point of minimal radius 152, but rather engages a stop adjacent to the point of minimal radius 152.

The rocker arm assembly 136 includes an elongated body 160 having a pivot point 162, a cam follower 164, and a ram body contact point 166. The rocker arm assembly body 160 is pivotally coupled to housing assembly 12 and/or side plates 27 at the rocker arm body pivot point 162. The rocker arm assembly body 160 may rotate about the rocker arm body pivot point 162 and is structured to move between a first position, wherein the rocker arm body ram body contact point 166 is disposed adjacent to the base plate 110, and a second position, wherein the rocker arm body ram body contact point 166 is adjacent to the stop plate 112. As used immediately above, "adjacent" is a comparative adjective relating to the positions of the rocker arm assembly body 160. The rocker arm body ram body contact point 166 is structured to engage and move the ram body 94. As shown, the rocker arm body ram body contact point 166 engages a bearing 101 (FIG. 3) disposed about the axle of one of the ram body rollers 100. The rocker arm assembly body 160 moves within a plane that is generally parallel to the ram body 94 path of travel and, more preferably, in a plane generally parallel to the plane of the side plates 27. The rocker arm body cam follower 164 extends generally perpendicular to the longitudinal axis of the rocker arm assembly body 160 and is structured to engage the outer cam surface 150. The rocker arm body cam follower 164 may include a roller 170.

The closing assembly 54 is assembled in the housing assembly 12 as follows. The toggle assembly 58 is disposed with the first link outer end 74 being rotatably coupled to the housing assembly 12 and/or side plates 27. The second link outer end 76 is rotatably coupled to the pole shaft 56 and, more specifically, rotatably coupled to a mounting point 66. The ram assembly 60 is disposed adjacent to the toggle assembly 58 with the ram body forward surface 96 adjacent to the toggle joint 82. That is, the toggle assembly 58 and the ram assembly 60 are positioned relative to each other so that the toggle joint 82 is disposed within the ram body 94 path of travel. More specifically, the toggle joint 82 also moves through a path as the toggle assembly 58 moves between the first, collapsed configuration and the second, over-toggle configuration. The path of the toggle joint 82 is disposed, generally, within the ram body 94 path of travel. Thus, the ram body 94 is structured to engage the toggle joint 82. In a preferred embodiment, the ram body 94 path of travel does not extend to the position of the toggle joint 82 when the toggle assembly 58 is in the second, over-toggle configuration.

The rocker arm assembly 136 assembly is disposed within the housing assembly 12 adjacent to the ram assembly 60. More specifically, the rocker arm body ram body contact point 166 is disposed so as to contact the forward side, that is the side opposite the at least one spring 90, of a ram body roller 100. In this configuration, rotation of the cam 134 causes the ram body 94 to move between the second, extended position and the first, retracted position. That is, assuming the ram body 94 is in the second, extended position and the cam follower 164 is disposed on the outer cam surface 150 at a point adjacent to the outer cam surface point of minimal radius 152, then the rocker arm assembly body 160 is in the second position. Upon actuation of the charging operator 130, the cam shaft 132 and the cam 134 rotate causing the cam follower 164 to move over the outer cam surface 150. At the point where the cam follower 164 engages the outer cam surface 150, the relative radius of the outer cam surface 150 increases with the continued rotation. As the relative radius of the outer cam surface 150 is increasing, the rocker arm assembly body 160 is moved to the first position. As the rocker arm assembly body 160 is moved to the first position, the rocker arm body ram body contact point 166 engages the ram body bearing 101 and moves the ram body 94 to the first position, thereby compressing the at least one spring 90. When the ram body 94 is moved to the first position, the rocker arm body cam follower 164 is disposed at the stop radius 155. When the rocker arm body cam follower 164 is disposed on the stop radius 155, the force from the at least one spring 90 is transferred via the ram body 94 and the rocker arm assembly body 160 to the cam 134. That is, the force is being applied in a generally radially inward direction. Because the cam radius at the stop radius 155 is less than at the cam point of greatest radius 154, the cam is encouraged to rotate away from the cam point of greatest radius 154, i.e. toward the step 156. The rotation of the cam shaft 132 is controlled by the latch assembly 180, discussed below.

In this position, any further rotation of the cam 134 will allow the rocker arm body cam follower 164 to fall over the step 156. After the rocker arm body cam follower 164 falls over the step 156, the rocker arm body cam follower 164 does not operatively engage the cam 134. That is, while there may be some minor force applied to the cam 134 by the rocker arm body cam follower 164, this force is not significant, does not cause the cam 134 to rotate, and does not cause significant wear and tear on the cam 134. It is noted that the cam 134 may rotate due to momentum imparted by the rocker arm body cam follower 164 prior to the rocker arm body cam follower 164 to falling over the step 156. Further, as the rocker arm body cam follower 164 falls over the step 156, the rocker arm assembly body 160 is free to move to the second position as the rocker arm body cam follower 164 is now disposed adjacent to the outer cam surface point of minimal radius 152. It is observed that, when the rocker arm body cam follower 164 is disposed at the outer cam surface stop radius 155, the cam 134 engaging the rocker arm assembly 136, which further engages the ram assembly 60, maintains the at least one spring 90 in the charged state.

The cam 134 and the rocker arm assembly 136 are maintained in the charged configuration by a latch assembly 180. The latch assembly 180 includes a latch lobe 182, a latch roller 184, latch prop 186 and a latch D-shaft 188. The latch lobe 182 is fixed to the cam shaft 132 and maintains a specific orientation relative to the cam 134. The latch roller 184 is rotatably coupled to the latch prop 186 and is structured to roll over the surface of the latch lobe 182. The latch prop 186 has an elongated, generally flat body 190 having a latch roller 184 mounting 192, a pivot point 194 and a latch edge 196. The latch prop body 190 is pivotally coupled to a side plate 27 and is structured to pivot, or rock, between a first position (FIG. 2A) and a second position (FIG. 2B). In the first position, the latch edge 196 engages the outer diameter of the latch D-shaft 188 and is held in place thereby. In turn, the latch roller 184 is held in place against the latch lobe 182 and prevents the cam shaft 132 from rotating. The latch D-shaft 188 is structured to rotate in response to a user input, e.g. actuation of a solenoid (not shown). When the latch D-shaft 188 rotates, the latch edge 196 passes over the latch D-shaft 188 as is known in the art. This allows the latch prop body 190 to move into the second position. When the latch prop body 190 is in the second position, the latch roller 184 does not engage the latch lobe 182 and, due to the bias of the at least one spring 90, as discussed above, the cam shaft 132 will rotate.

In this configuration, the closing assembly 54 operates as follows. For the sake of this discussion the electrical switching apparatus 10 will be initially described in the typical condition following an over current condition. That is, when the at least one pair of separable contacts 26 are in the first, open position, the pole shaft 56 is in the first position, the toggle assembly 58 is in the first configuration, the ram body 94 is in the first position and the at least one spring 90 is charged, and the rocker arm assembly body 160 is in the first position. To close the at least one pair of separable contacts 26, an operator actuates the latch assembly 180 to allow the latch D-shaft 188 to rotate as set forth above. When the cam shaft 132 is no longer retained by the latch assembly 180, the cam 134 rotates slightly so as to allow the rocker arm body cam follower 164 to fall over the step 156. When the rocker arm body cam follower 164 falls over the step 156, the rocker arm assembly body 160 is free to move to the second position as the rocker arm body cam follower 164 now engages the outer cam surface 150 at a point adjacent to the outer cam surface point of minimal radius 152. At this point, the at least one spring 90 is no longer restrained and the at least one spring 90 moves the ram body 94 from the first, retracted position toward the second, extended position. As the ram body 94 moves from the first, retracted position toward the second, extended position, the ram body forward surface 96 engages the toggle joint 82 and causes the toggle assembly 58 to move from the first, collapsed configuration to the second, over-toggle configuration. As noted above, the ram body 94 path of travel does not extend to the position of the toggle joint 82 when the toggle assembly 58 is in the second, over-toggle configuration. Preferably, the ram body 94 moves with sufficient speed and energy so that, when the ram body 94 reaches the end of the path of travel, the toggle assembly 58 is a few degrees over toggle but not at its final over toggle resting point. Once the toggle assembly 58 is over the toggle point by only a few degrees, the forces of the at least one spring 90 and whatever the remaining momentum of the ram body 94 continue the motion of the toggle assembly 58 towards the second, over-toggle configuration, thereby creating a space between the ram body forward surface 96 and the toggle joint 82.

As the toggle assembly 58 is moved into the second, over-toggle configuration, the pole shaft 56 is also moved into its second position. As the pole shaft 56 is moved into its second position, the at least one pair of separable contacts 26 are moved from the first, open position to the second closed position. At this point the closing operation is complete, however, it is preferred that the operator again engages the charging operator 130 to cause the cam 134 to rotate so that the outer cam surface point of greatest radius 154 again engages the cam follower 164. As described above, the rotation of the cam 134 to this position acts to charge the at least one spring 90. Thus, the at least one spring 90 is charged and ready to close the at least one pair of separable contacts 26 following another over current condition.

It is further noted that the latch assembly 180 is structured to have reduced latch loads applied thereto. This is accomplished by having the force applied to the latch assembly 180 essentially pass through the latch body pivot point 194. To have the force applied to the latch assembly 180 essentially pass through the latch body pivot point 194, the latch assembly 180 is structured as follows. The latch prop body 190, as noted above, is generally flat. The latch roller 184 is disposed on a latch roller axle 183 that extends generally perpendicular to, and out of the plane of, the latch prop body 190. The latch prop body 190 is further disposed adjacent to, the latch lobe 182. Thus, the latch roller 184 is disposed in the plane of, and is structured to engage, the latch lobe 182.

Figure 6:
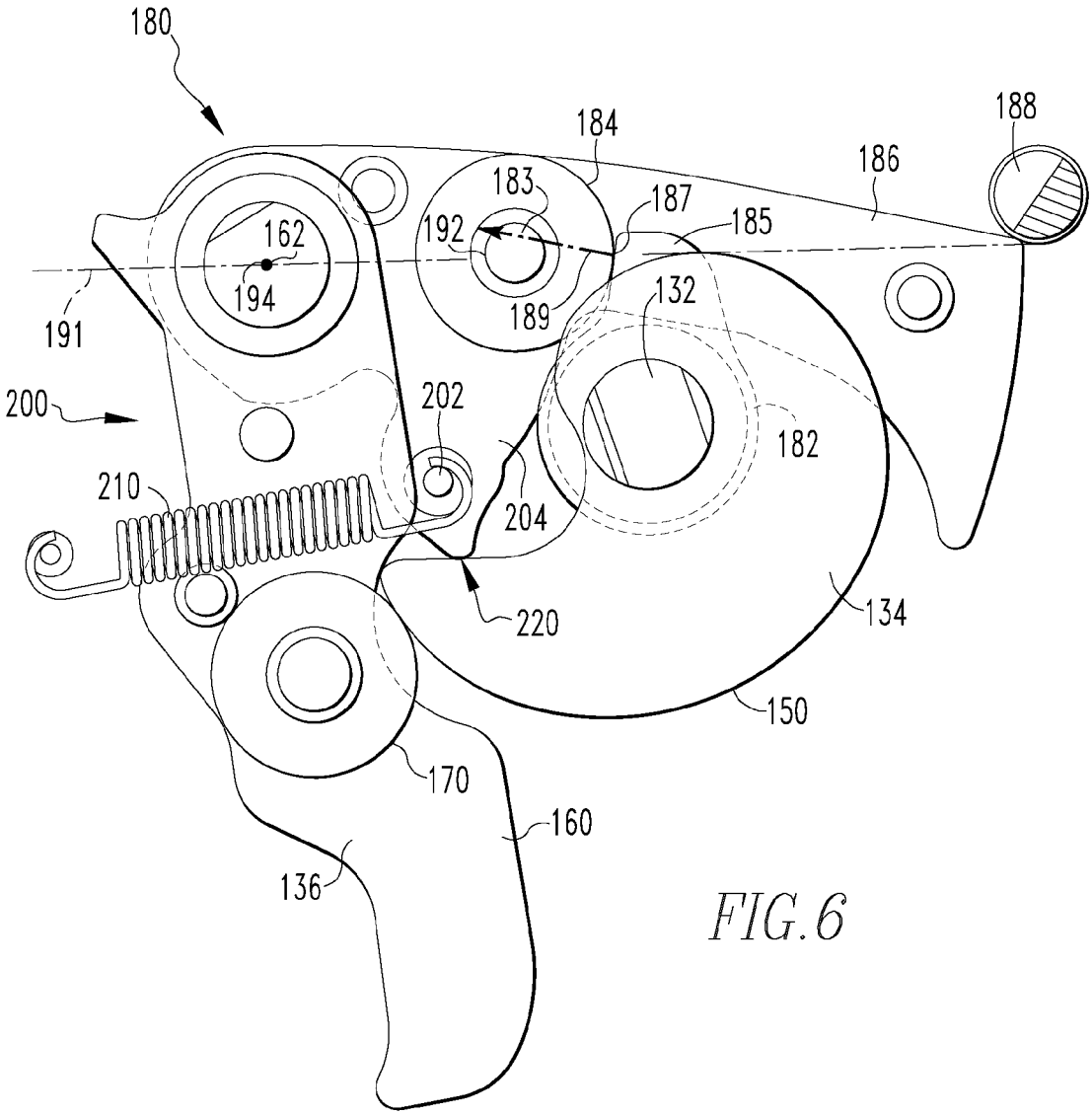
FIG. 6 is a schematic side view of the latch assembly in a first position.
Figure 7:
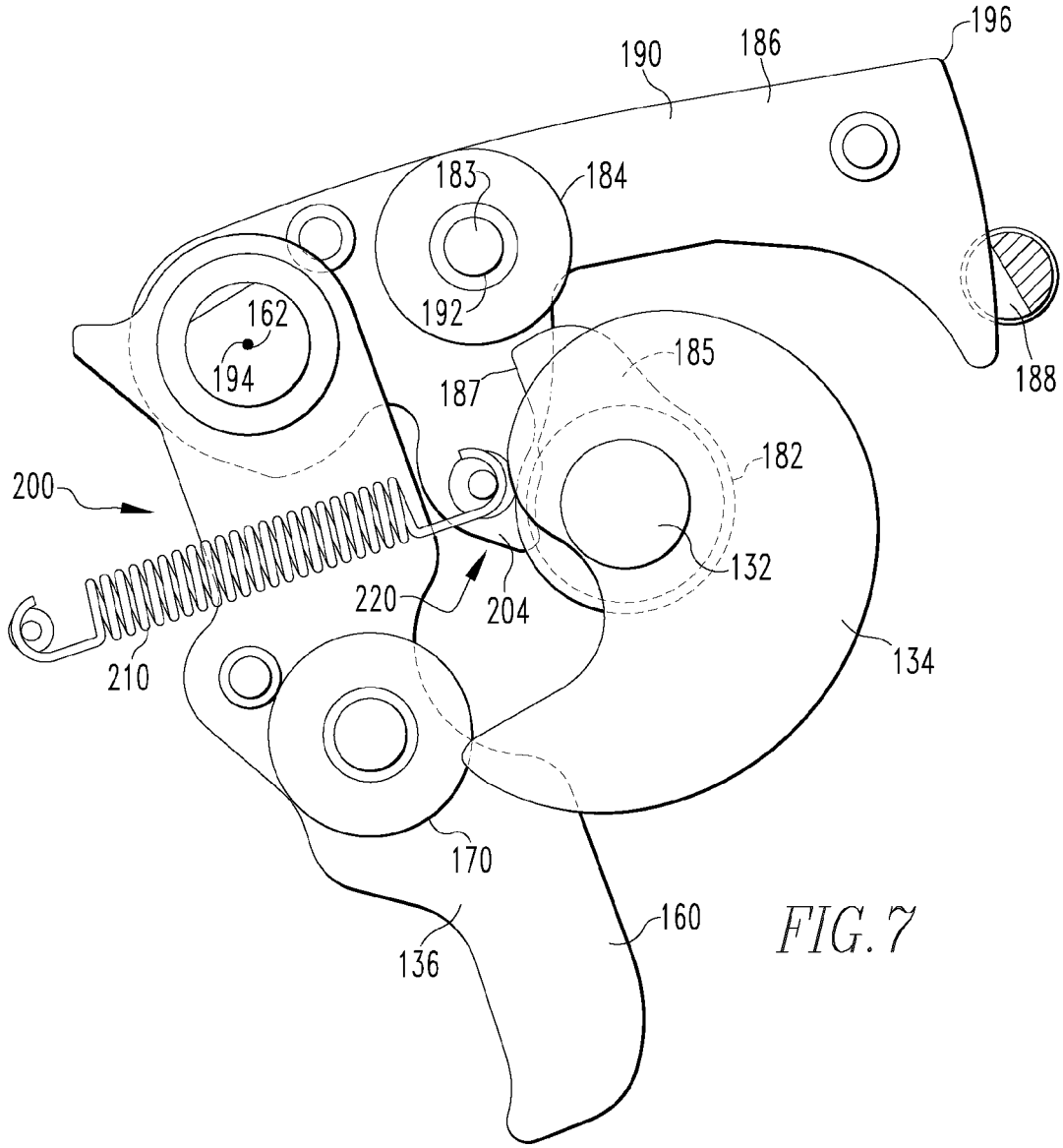
FIG. 7 is a schematic side view of the latch assembly in a second position.

More specifically, the latch lobe 182, preferably, includes a generally flat radial extension 185 having a generally flat roller engagement surface 187. The roller engagement surface 187 engages the latch roller 184 when the latch prop body 190 is in the first position (FIGS. 2A and 6). It is noted that the force created by the at least one spring 90, acting through the roller engagement surface 187, acts in a line, that is, a line of force 189, that extends above the latch prop body pivot point 194 as shown. Preferably, the roller engagement surface 187 is angled away from the latch roller axle 183 relative to the line of force 189 and the cam shaft 132. In this configuration, the force acting upon the latch roller 184, and therefore the latch prop body 190, biases the latch prop body 190 to rotate in a counterclockwise direction, as shown in the figures. That is, given a line of action 191 extending from the latch prop body pivot point 194 to the latch roller axle 183, the line of force 189 extends to the side of the line of action 191 opposite the cam shaft 132. Further, because the radial extension 185 is angled away from the line of force 189 and the cam shaft 132, as the latch prop body 190 rotates in a counterclockwise direction, the latch roller 184 will move over the surface of the radial extension 185 until the latch roller 184 passes over the radial extension 185, as shown in FIG. 7.

This force is further applied to the latch prop body 190 via the latch roller 184. That is, when the latch prop body 190 is in the first position the radial extension 185 engages the latch roller 184. The force is biasing the latch lobe 182, and therefore the radial extension 185, is applied in a counterclockwise direction as shown. Because the roller engagement surface 187 is angled away from the latch roller axle 183 relative to a line of force 189, the latch roller 184 is biased to roll over the roller engagement surface 187 and away from the cam shaft 132. Because the latch roller 184 is coupled to the latch prop body 190 by the latch roller axle 183, this bias is also applied to the latch prop body 190. The motion of the latch prop body 190 is arrested by the latch D-shaft 188 which engages the latch edge 196. Accordingly, when the latch D-shaft 188 is released, as described above, the force acting on the latch assembly 180 causes the latch roller 184 to roll over the roller engagement surface 187 and away from the cam shaft 132. This, in turn, causes the latch prop body 190 to move into the second position (FIG. 2B).

To reduce torque or cantilevered forces in the latch assembly 180 when the latch prop body 190 is in the first position, the latch roller axle 183 is positioned so that a line extending through the latch roller axle 183 and the latch prop body pivot point 194 is generally parallel to the line of force 189. Although there is a slight torque created on the latch roller axle 183 as the force created by the latch lobe 182 being in a different plane than the latch prop body 190, generally torque is eliminated as the force being applied to the latch prop body 190 via the latch roller axle 183 is applied generally through the latch prop body pivot point 194. It is further preferred that the latch edge 196 is also disposed along the line extending through the latch roller axle 183 and the latch prop body pivot point 194. Thus, when the latch prop body 190 is in the first position, the line of action 191 generally extends through the point of contact between the latch edge 196 and the latch D-shaft 188 and the latch prop body pivot point 194.

The closing assembly 54 also provides for the resetting of the latch assembly 180. That is, as discussed above, when the latch D-shaft 188 rotates, the latch edge 196 passes over the latch D-shaft 188 and allows the latch prop body 190 to move into the second position. However, in order to reset the ram body 94 in the first position, that is, prior to latching the at least one spring 90 in a compressed state, the latch prop body 190 must be returned to the first position so that the latch D-shaft 188 may engage the latch edge 196. This is accomplished by a latch reset assembly 200 shown in FIGS. 6-7, which is part of the latch assembly 180.

Initially it is noted that FIGS. 6-7 are schematic side views of the latch assembly 180 and the latch reset assembly 200. As noted above, the latch assembly 180 and the latch reset assembly 200 may be constructed of members disposed in, and moving in, selected planes. Such components may include generally similar sub-components having essentially identical shapes disposed in different laminations or layers. It is further understood that in such a configuration having various components disposed in layers and moving in planes, a lateral extension, or a roller disposed on a laterally extending axle, may be structured to engage a component disposed in an adjacent plane. For example, and as discussed above, the latch prop body 190 is disposed in one plane and includes a laterally extending axle to which a latch roller 184 is rotatably coupled. The latch prop body 190 is disposed adjacent to the latch lobe 182 and the latch lobe 182 travels in a separate, but parallel plane. In this configuration, the latch roller 184 is disposed in the plane of the latch lobe 182 and may be engaged thereby.

The latch reset assembly 200 is preferably a reset pin 202 disposed upon a coplanar perpendicular extension 204 to the latch prop body 190. The coplanar perpendicular extension 204 may be formed integrally with the latch prop body 190, and be in the same plane as the latch prop body 190, or may be a separate element that is couple to the latch prop body 190 and extends in a plane parallel to the plane of the latch prop body 190. The coplanar perpendicular extension 204 extends, generally, in a direction perpendicular to the line extending through the latch roller axle 183 and the latch prop body pivot point 194. In this configuration, the reset pin 202 may be disposed within the path of travel of the radial extension 185. That is, as the latch lobe 182 rotates with the cam shaft 132, the radial extension 185 travels through a path about the cam shaft 132. In the configuration described above, the coplanar perpendicular extension 204 extends toward the path of travel of the radial extension 185 when the latch prop body 190 is in the second position. As such, the laterally extending reset pin 202 is disposed in the path of travel of the radial extension 185. It is noted that the same effect may be accomplished by including a reset pin (not shown) extending from the latch lobe 182 and a notch (not shown), or other structure that may be engaged by the reset pin, on the coplanar perpendicular extension 204. In this configuration, the notch is structured to be operatively engaged by the reset pin as the cam 134 initially moves from the first position to the second position, but to further release the reset pin once the latch prop body 190 is returned to the latched position relative to the D-shaft 188.

As noted above, the charging operator 130 causes the cam 134, and therefore the cam shaft 132 and the latch lobe 182, to rotate in a counterclockwise direction, as shown. Thus, when the latch prop body 190 is in the second position (FIG. 7) and the reset pin 202 is disposed in the path of travel of the radial extension 185, as the latch lobe 182 rotates about the cam shaft 132, the radial extension 185 engages the reset pin 202 and moves the reset pin 202. As the reset pin 202 is moved, the latch prop body 190 is returned to the first position. That is, as the radial extension 185 engages the reset pin 202, the latch prop body 190 rotates about the latch body pivot point 194. As the latch prop body 190 enters the first position, the reset pin 202 moves out of the path of travel of the radial extension 185. Thus, the latch prop body 190 stops moving about the latch body pivot point 194 and is left in the first position. When the latch body pivot point 194 is in the first position, the latch D-shaft 188 reengages the latch edge 196.

The latch reset assembly 200 may further include a spring 210. The latch reset assembly spring 210 is coupled to, and extends between, the housing assembly 12 and the reset pin 202 and is positioned so as to bias the latch prop body 190 to the first position. Preferably, the latch reset assembly spring 210 is a tension spring. In this configuration, the reset pin 202 acts as a spring coupling 220. In an alternate embodiment, the latch reset assembly 200 relies only on a reset assembly spring 210. That is, the latch reset assembly 200 includes a latch reset assembly spring 210 and a spring coupling 220. A spring coupling 220 may be any structure to which a spring may be coupled, such as, but not limited to an opening, a rod, or a lug. The spring coupling 220 is disposed on the latch prop body 190. The latch reset assembly spring 210 extends between, the housing assembly 12 and the spring coupling 220 and is positioned so as to bias the latch prop body 190 to the first position.

While specific embodiments of the invention have been described in detail, it will be appreciated by those skilled in the art that various modifications and alternatives to those details could be developed in light of the overall teachings of the disclosure. The invention is disclosed in association with a low or medium voltage electrical switching apparatus, although the invention is applicable to a wide range of electrical switching apparatus (e.g., without limitation, reclosers, circuit switching devices and other circuit interrupters, such as contactors, motor starters, motor controllers and other load controllers) suitable for a wide range of voltages (e.g., without limitation, low voltage to high voltage electrical switching apparatuses). Accordingly, the particular arrangements disclosed are meant to be illustrative only and not limiting as to the scope of invention which is to be given the full breadth of the claims appended and any and all equivalents thereof.

What is claimed is:

1. A latch assembly for an operating mechanism closing assembly for an electrical switching apparatus, said electrical switching apparatus having a housing assembly and at least one pair of contacts having a fixed contact and a movable contact disposed in said housing assembly, said movable contact structured to move between a first, open position, wherein said contacts are separated, and a second, closed position, wherein said contacts contact each other and are in electrical communication, said operating mechanism closing assembly having a charging assembly, said charging assembly having a cam fixed to a cam shaft, said cam selectively having a force applied thereto and structured to rotate said cam shaft, said operating mechanism closing assembly further having a latch D-shaft structured to rotate upon an input from a user, said latch assembly comprising:

a latch lobe having a generally radial extension, said latch lobe fixed to said cam shaft;

a latch prop having an elongated body, a roller axle extending generally perpendicular to said body, a roller disposed on said roller axle, a pivot point and a latch edge, said latch edge structured to engage said latch D-shaft;

said latch prop body pivotally coupled to said housing assembly and disposed in a plane adjacent to said latch lobe, said latch prop body structured to move between a first position and a second position;

wherein, when said latch lobe body is in said first position, said latch roller engages said latch lobe radial extension;

wherein said force applied to said cam is transferred via said camshaft to said latch lobe radial extension, said latch lobe radial extension applying a force to said latch roller when said latch lobe body is in said first position, said force applied along a line of force;

said latch prop body pivot point and said latch roller axle define a line of action; and said line of force extends to the side of the line of action opposite said cam shaft.

2. The latch assembly of claim 1 wherein:

when said latch lobe body is in said first position, said latch edge engages said latch D-shaft; and wherein said line of action further extends, generally, through the point of contact between said latch edge and said latch D-shaft.

3. An electrical switching apparatus comprising:

a housing assembly defining an enclosed space;

a plurality of side plates, said side plates disposed within said housing assembly enclosed space, generally parallel to each other, said side plates having a plurality of aligned openings therein whereby one or more elongated members may be coupled, including rotatably coupled, perpendicular to and between adjacent side plates;

at least one pair of contacts having a fixed contact and a movable contact disposed in said housing assembly, said movable contact structured to move between a first, open position, wherein said contacts are separated, and a second, closed position, wherein said contacts contact each other and are in electrical communication;

an operating mechanism closing assembly disposed in said housing assembly, said operating mechanism closing assembly having a charging assembly and a latch D-shaft;

said charging assembly having a cam fixed to a cam shaft, said cam selectively having a force applied thereto and structured to rotate said cam shaft, said cam shaft rotatably coupled to said housing assembly;

said latch D-shaft structured to rotate upon an input from a user;

a latch assembly having a latch lobe and a latch prop;

said latch lobe having a radial extension, said latch lobe fixed to said cam shaft;

said latch prop having an elongated body, a roller axle extending generally perpendicular to said body, a roller disposed on said roller axle, a pivot point and a latch edge, said latch edge structured to engage said latch D-shaft;

said latch prop body pivotally coupled to said housing assembly and disposed in a plane adjacent to said latch lobe, said latch prop body structured to move between a first position and a second position;

wherein, when said latch lobe body is in said first position, said latch roller engages said latch lobe radial extension;

wherein said force applied to said cam is transferred via said cam shaft to said latch lobe radial extension, said latch lobe radial extension applying a force to said latch roller when said latch lobe body is in said first position, said force applied along a line of force;

said latch prop body pivot point and said latch roller axle define a line of action; and said line of force extends to the side of the line of action opposite said cam shaft.

4. The electrical switching apparatus of claim 3 wherein:

when said latch lobe body is in said first position, said latch edge engages said latch D-shaft; and wherein said line of action further extends, generally, through the point of contact between said latch edge and said latch D-shaft.

5. The electrical switching apparatus of claim 3 wherein:

said latch lobe radial extension has a roller engagement surface, said roller engagement surface being generally flat; and said roller engagement surface being angled away from said roller axle relative to said line of force.

6. A latch assembly for an operating mechanism closing assembly for an electrical switching apparatus, said electrical switching apparatus having a housing assembly and at least one pair of contacts having a fixed contact and a movable contact disposed in said housing assembly, said movable contact structured to move between a first, open position, wherein said contacts are separated, and a second, closed position, wherein said contacts contact each other and are in electrical communication, said operating mechanism closing assembly having a charging assembly, said charging assembly having a cam fixed to a cam shaft, said cam selectively having a force applied thereto and structured to rotate said cam shaft, said operating mechanism closing assembly further having a latch D-shaft structured to rotate upon an input from a user, said latch assembly comprising:

a latch lobe having a radial extension, said latch lobe fixed to said cam shaft, said radial extension having a path of travel about said cam shaft;

a latch prop having an elongated, flat body, a roller axle extending generally perpendicular to said body, a roller disposed on said roller axle, a pivot point, a latch edge, said latch edge structured to engage said latch D-shaft, and a latch reset assembly;

said latch prop body pivotally coupled to said housing assembly and disposed in a plane adjacent to said latch lobe, said latch prop body structured to move between a first position and a second position;

a latch reset assembly including a coplanar perpendicular extension and a reset pin disposed on said coplanar perpendicular extension, said coplanar perpendicular extension extending from said latch prop body in a coplanar manner;

said reset pin extending laterally, and generally perpendicular to, said coplanar perpendicular extension;

wherein, when said latch prop body is in said second position, said reset pin is disposed in said radial extension path of travel and when said latch prop body is in said first position, said reset pin is not disposed in said radial extension path of travel; and wherein, when said latch prop body is in said second position, and said cam shaft rotates, said radial extension engages said reset pin and further rotation of said cam shaft causes said latch prop body to move into said first position.

7. The latch assembly of claim 6 wherein:

said latch reset assembly further includes a spring;

said spring coupled to, and extending between, said housing assembly and said reset pin; and said spring structured to bias said latch prop body toward said first position.

8. The latch assembly of claim 7 wherein said spring is a tension spring.

9. An electrical switching apparatus comprising:

a housing assembly defining an enclosed space;

a plurality of side plates, said side plates disposed within said housing assembly enclosed space, generally parallel to each other, said side plates having a plurality of aligned openings therein whereby one or more elongated members may be coupled, including rotatably coupled, perpendicular to and between adjacent side plates;

at least one pair of contacts having a fixed contact and a movable contact disposed in said housing assembly, said movable contact structured to move between a first, open position, wherein said contacts are separated, and a second, closed position, wherein said contacts contact each other and are in electrical communication;

an operating mechanism closing assembly disposed in said housing assembly, said operating mechanism closing assembly having a charging assembly and a latch D-shaft;

said charging assembly having a cam fixed to a cam shaft, said cam selectively having a force applied thereto and structured to rotate said cam shaft, said cam shaft rotatably coupled to said housing assembly;

said latch D-shaft structured to rotate upon an input from a user;

a latch assembly having a latch lobe and a latch prop;

said latch lobe having a radial extension, said latch lobe fixed to said cam shaft, said radial extension having a path of travel about said cam shaft;

said latch prop having an elongated, flat body, a roller axle extending generally perpendicular to said body, a roller disposed on said roller axle, a pivot point, a latch edge, said latch edge structured to engage said latch D-shaft, and a latch reset assembly;

said latch prop body pivotally coupled to said housing assembly and disposed in a plane adjacent to said latch lobe, said latch prop body structured to move between a first position and a second position;

a latch reset assembly including a coplanar perpendicular extension and a reset pin disposed on said coplanar perpendicular extension, said coplanar perpendicular extension extending from said latch prop body in a coplanar manner;

said reset pin extending laterally, and generally perpendicular to, said coplanar perpendicular extension;

wherein, when said latch prop body is in said second position, said reset pin is disposed in said radial extension path of travel and when said latch prop body is in said first position, said reset pin is not disposed in said radial extension path of travel; and wherein, when said latch prop body is in said second position, and said cam shaft rotates, said radial extension engages said reset pin and further rotation of said cam shaft causes said latch prop body to move into said first position.

10. The electrical switching apparatus of claim 9 wherein:

said latch reset assembly further includes a spring;

said spring coupled to, and extending between, said housing assembly and said reset pin; and said spring structured to bias said latch prop body toward said first position.

11. The electrical switching apparatus of claim 10 wherein said spring is a tension spring.

12. A latch assembly for an operating mechanism closing assembly for an electrical switching apparatus, said electrical switching apparatus having a housing assembly and at least one pair of contacts having a fixed contact and a movable contact disposed in said housing assembly, said movable contact structured to move between a first, open position, wherein said contacts are separated, and a second, closed position, wherein said contacts contact each other and are in electrical communication, said operating mechanism closing assembly having a charging assembly, said charging assembly having a cam fixed to a cam shaft, said cam selectively having a force applied thereto and structured to rotate said cam shaft, said operating mechanism closing assembly further having a latch D-shaft structured to rotate upon an input from a user, said latch assembly comprising:

a latch lobe having a radial extension, said latch lobe fixed to said cam shaft, said radial extension having a path of travel about said cam shaft;

a latch prop having an elongated, flat body, a roller axle extending generally perpendicular to said body, a roller disposed on said roller axle, a pivot point, a latch edge, said latch edge structured to engage said latch D-shaft, and a latch reset assembly;

said latch prop body pivotally coupled to said housing assembly and disposed in a plane adjacent to said latch lobe, said latch prop body structured to move between a first position and a second position;

a latch reset assembly including a spring coupling and a spring;

said spring coupling is coupled to said latch prop body;

said spring coupled to, and extending between, said housing assembly and said spring coupling; and said spring structured to bias said latch prop body toward said first position.

13. The latch assembly of claim 12 wherein said spring is a tension spring.

14. The latch assembly of claim 12 wherein:

said latch reset assembly further includes a coplanar perpendicular extension; and said spring coupling is disposed on said coplanar perpendicular extension.

15. An electrical switching apparatus comprising:

a housing assembly defining an enclosed space;

a plurality of side plates, said side plates disposed within said housing assembly enclosed space, generally parallel to each other, said side plates having a plurality of aligned openings therein whereby one or more elongated members may be coupled, including rotatably coupled, perpendicular to and between adjacent side plates;

at least one pair of contacts having a fixed contact and a movable contact disposed in said housing assembly, said movable contact structured to move between a first, open position, wherein said contacts are separated, and a second, closed position, wherein said contacts contact each other and are in electrical communication;

an operating mechanism closing assembly disposed in said housing assembly, said operating mechanism closing assembly having a charging assembly and a latch D-shaft;

said charging assembly having a cam fixed to a cam shaft, said cam selectively having a force applied thereto and structured to rotate said cam shaft, said cam shaft rotatably coupled to said housing assembly;

said latch D-shaft structured to rotate upon an input from a user;

a latch assembly having a latch lobe and a latch prop;

said latch lobe having a radial extension, said latch lobe fixed to said cam shaft, said radial extension having a path of travel about said cam shaft;

said latch prop having an elongated, flat body, a roller axle extending generally perpendicular to said body, a roller disposed on said roller axle, a pivot point, a latch edge, said latch edge structured to engage said latch D-shaft, and a latch reset assembly;

said latch prop body pivotally coupled to said housing assembly and disposed in a plane adjacent to said latch lobe, said latch prop body structured to move between a first position and a second position;

a latch reset assembly including a spring coupling and a spring;

said spring coupling is coupled to said latch prop body;

said spring coupled to, and extending between, said housing assembly and said spring coupling; and said spring structured to bias said latch prop body toward said first position.

16. The latch assembly of claim 15 wherein said spring is a tension spring.

17. The latch assembly of claim 15 wherein:

said latch reset assembly further includes a coplanar perpendicular extension; and said spring coupling is disposed on said coplanar perpendicular extension.

* * * * *